US007507305B2

(12) United States Patent
Kawasaki et al.

(10) Patent No.: US 7,507,305 B2
(45) Date of Patent: Mar. 24, 2009

(54) WEAR-RESISTANT COPPER-BASED ALLOY

(75) Inventors: Minoru Kawasaki, Toyota (JP); Tadashi Oshima, Aichi-gun (JP); Takao Kobayashi, Seto (JP); Kazuyuki Nakanishi, Seto (JP); Hideo Tachikawa, Nisshin (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 338 days.

(21) Appl. No.: 10/580,463

(22) PCT Filed: Dec. 10, 2004

(86) PCT No.: PCT/JP2004/018870

§ 371 (c)(1),
(2), (4) Date: May 25, 2006

(87) PCT Pub. No.: WO2005/005190

PCT Pub. Date: Jun. 30, 2005

(65) Prior Publication Data

US 2007/0125458 A1 Jun. 7, 2007

(30) Foreign Application Priority Data

Dec. 17, 2003 (JP) ..... 2003-419734

(51) Int. Cl.
*C22C 9/06* (2006.01)

(52) U.S. Cl. ..... 148/435; 420/487; 420/587

(58) Field of Classification Search ..... 148/435; 420/487, 587

See application file for complete search history.

(56) References Cited

U.S. PATENT DOCUMENTS

| | | | | |
|---|---|---|---|---|
| 5,004,581 A | | 4/1991 | Takagi et al. | |
| 5,188,799 A | | 2/1993 | Mori et al. | |
| 5,843,243 A | * | 12/1998 | Kawasaki et al. | 148/435 |
| 5,911,949 A | | 6/1999 | Ninomiya et al. | |

FOREIGN PATENT DOCUMENTS

| | | | |
|---|---|---|---|
| EP | 0 320 195 A1 | | 6/1989 |
| EP | 0 505 172 A1 | | 9/1992 |
| EP | 0 727 501 A1 | | 8/1996 |
| EP | 0 939 139 A2 | | 9/1999 |
| EP | 1 361 288 A1 | | 11/2003 |
| JP | 60110867 | * | 6/1985 |
| JP | 03-087327 | | 4/1991 |
| JP | 04-297536 | | 10/1992 |
| JP | 08-225868 | | 9/1996 |
| JP | 2001-105177 A | | 4/2001 |

* cited by examiner

*Primary Examiner*—Sikyin Ip
(74) *Attorney, Agent, or Firm*—Kenyon & Kenyon LLP

(57) ABSTRACT

This aims to provide a wear-resistant copper-based alloy, which is advantages in not only enhancing wear resistance in a high temperature range but also enhancing crack resistance and machinability and which is especially suitable for forming a cladding layer. The wear-resistant copper-based alloy comprises, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% one or more of tantalum, titanium, zirconium and hafnium, and the balance of copper with inevitable impurities.

11 Claims, 5 Drawing Sheets

WEAR-RESISTANT COPPER-BASED ALLOY

This is a 371 national phase application of PCT/JP2004/018870 filed 10 Dec. 2004, claiming priority to Japanese Application No. 2003-419734 filed 17 Dec. 2003, the contents of which are incorporated herein by reference.

TECHNICAL FIELD

The present invention relates to a wear-resistant copper-based alloy. The present invention can be applied, for instance, to materials for sliding members.

BACKGROUND ART

Conventionally known as wear-resistant copper-based alloys are beryllium-added copper alloys, copper-nickel-silicon alloys known as Corson alloys, and dispersion-strengthened alloys in which hard oxide particles such as $SiO_2$, $Cr_2O_3$ and BeO particles are dispersed in a copper-based matrix. These alloys, however, have a problem of adhesion and do not always possess sufficient wear resistance.

In this connection, the present applicants have developed a wear-resistant copper-based alloy containing zinc and/or tin, which are more easily oxidized than copper. This copper-based alloy has upgraded in adhesion resistance because of generation of oxides of zinc and/or tin, and accordingly has improved in wear resistance. However, since zinc and tin have considerably lower melting points than that of copper, this alloy is not always satisfactory. Particularly when a cladding layer of the abovementioned copper-based alloy is formed by using such a high-density energy heat source as a laser beam, zinc and/or tin tend to evaporate during the cladding operation and it is not easy to maintain target concentrations of alloying elements. In this connection, recently the present applicants have developed wear-resistant copper-based alloys having a composition comprising, by weight, 10.0 to 30.0% nickel, 0.5 to 5.0% silicon, 2.0 to 15.0% iron, 1.0 to 10.0% chromium, 2.0 to 15.0% cobalt, and 2.0 to 15.0% one or more of molybdenum, tungsten, niobium and vanadium. (Patent Document No. 1: Japanese Unexamined Patent Publication No. H08-225,868 and Patent Document No. 2: Japanese Examined Patent Publication No. H07-17,978). These alloys mainly comprise hard particles including silicide of Co—Mo, and a Cu—Ni based matrix. These wear-resistant copper-based alloys secure their wear resistance primarily by the hard particles including silicide of Co—Mo, while these wear-resistant copper-based alloys secure their crack resistance primarily by the Cu—Ni based matrix. These alloys exhibit high wear resistance even when used under severe conditions. Moreover, since neither zinc nor tin is used as a positive element, even if these alloys are used for cladding, there are little inconveniences caused by evaporation of alloying elements and fumes generate in a smaller amount. Consequently, these alloys are especially suitable for forming a cladding layer by using a high-density energy heat source such as a laser beam.

As mentioned above, the alloys according to Patent Document No. 3 (Japanese Unexamined Patent Publication No. H08-225,868) and Patent Document No. 4 (Japanese Examined Patent Publication No. H07-17,978) exhibit excellent wear resistance even when used under severe conditions. Particularly in an oxidizing atmosphere or in the air these alloys exhibit excellent wear resistance because of generation of an oxide which shows favorable solid lubrication.

However, although having an effect of improving wear resistance, the above silicide of Co—Mo is so hard and brittle that when the composition of these alloys is controlled to increase the area ratio of the hard particles, the wear-resistant copper-based alloys deteriorate in terms of crack resistance. Especially when these wear-resistant copper-based alloys are used for cladding, the cladding layer sometimes cracks and the cladding yield rate deteriorates. In contrast, when the composition of these alloys is controlled to decrease the area ratio of the hard particles in the wear-resistant copper-based alloys, these wear-resistant copper-based alloys deteriorate in terms of wear resistance.

In recent years, the above wear-resistant copper-based alloys have been used under a variety of environments and their service conditions are getting severer. Therefore, wear-resistant copper-based alloys have been requested to be capable of exhibiting excellent wear resistance under various environments. In the industrial world, there is demand for an alloy which has good wear resistance, crack resistance and machinability in a balanced manner when compared with those of the alloys according to the above publications.

[Patent Document No. 1] Japanese Unexamined Patent Publication No. H08-225,868

[Patent Document No. 2] Japanese Examined Patent Publication No. H07-17,978

[Patent Document No. 3] Japanese Unexamined Patent Publication No. H08-225,868

[Patent Document No. 4] Japanese Examined Patent Publication No. H07-17,978

DISCLOSURE OF INVENTION

The present invention has been developed in view of the abovementioned circumstances. It is an object of the present invention to provide a wear-resistant copper-based alloy which is advantageous in not only enhancing wear resistance in a high temperature range but also enhancing crack resistance and machinability, which is particularly suitable for forming a cladding layer, and which has good wear resistance, crack resistance and machinability in a balanced manner.

The present inventors have made earnest studies with the abovementioned object and have focused their attention on the fact that silicide of Co—Mo, which is a principal component of hard particles, is hard and brittle (generally about Hv1200) and tend to be a starting point of cracks. Then, the present inventors have found that hard and brittle silicide of Co—Mo can be reduced or deleted and the ratio of silicide of Fe—Mo, which has a lower hardness and a slightly higher toughness than those of silicide of Co—Mo, can be increased by decreasing the cobalt content and increasing the molybdenum content instead. As a result, recently the present inventors have developed a wear-resistant copper-based alloy which can not only enhance wear resistance in a high temperature range but also enhance crack resistance and machinability in a balanced manner. Besides, the present inventors have found that the inclusion of niobium carbide in this alloy contributes to the refinement of hard particles and leads not only to the enhancement of wear resistance in a high temperature range but also to the enhancement of crack resistance and machinability in a balanced manner, and have recently developed a wear-resistant copper-based alloy containing niobium carbide.

The present invention has been made as a part of the above research and development. The present inventors have found that hard and brittle silicide of Co—Mo can be reduced or deleted and the ratio of silicide which has lower hardness and slightly higher toughness than those of silicide of Co—Mo can be increased by decreasing the cobalt content and including one or more of tantalum, titanium, zirconium and hafnium instead of or together with molybdenum, and that thereby a wear-resistant copper-based alloy can be provided which can not only enhance wear resistance in a high temperature range but also enhance crack resistance and machinability in a better-balanced manner.

On the base of these findings, the present inventors have developed a wear-resistant copper-based alloy according to a first aspect of the present invention which can not only enhance wear resistance in a high temperature range but also enhance crack resistance and machinability in a balanced manner by reducing the cobalt content and the nickel content and including one or more of tantalum, titanium, zirconium and hafnium in the above-mentioned alloy composition according to Japanese Unexamined Patent Publication No. H08-225,868 and Japanese Examined Patent Publication No. H07-17, 978.

Moreover, the present inventors have found that wear resistance in a high temperature range, crack resistance and machinability can be further enhanced when the wear-resistant copper-based alloy according to the first aspect of the invention includes: 2.7 to 22.0% one or more of molybdenum, tungsten, vanadium, tantalum, titanium, zirconium, hafnium, molybdenum, tungsten and vanadium and; 0.01 to 5.0% molybdenum carbide, tungsten carbide, vanadium carbide, chromium carbide, tantalum carbide, titanium carbide, zirconium carbide and hafnium carbide. The present inventors have developed a wear-resistant copper-based alloy according to a second aspect of the present invention based on this finding.

It is assumed as a major reason why the abovementioned effects can be obtained that tantalum, titanium, zirconium and hafnium as well as molybdenum, tungsten and vanadium can generate both a Laves phase and a carbide hard phase in hard particles and accordingly can increase the ratio of silicide which has lower hardness and slightly higher toughness than those of silicide of Co—Mo in the hard particles.

Namely, the wear-resistant copper-based alloy according to the first aspect of the present invention characteristically comprises, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% one or more of tantalum, titanium, zirconium and hafnium, and the balance of copper with inevitable impurities.

The wear-resistant copper-based alloy according to the second aspect of the present invention characteristically comprises, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% one or more of molybdenum, tungsten, vanadium, tantalum, titanium, zirconium and hafnium, 0.01 to 5.0% one or more of molybdenum carbide, tungsten carbide, vanadium carbide, chromium carbide, tantalum carbide, titanium carbide, zirconium carbide and hafnium carbide, and the balance of copper with inevitable impurities.

It is to be noted that % means % by weight in this specification, unless otherwise noted.

ADVANTAGES OF THE INVENTION

The wear-resistant copper-based alloys according to the first and second aspects of the invention are advantageous in not only enhancing wear resistance in a high temperature range but also enhancing crack resistance and machinability, and accordingly can satisfy requirements for wear resistance, crack resistance and machinability in a balanced manner. Especially these alloys can improve in crack resistance as demonstrated by the data in the following examples of the present invention.

Moreover, when used for cladding, these wear-resistant copper-based alloys can satisfy requirements for not only wear resistance, crack resistance and machinability but also cladding operability in a balanced manner.

BEST MODES FOR CARRYING OUT THE INVENTION

Figure 1:
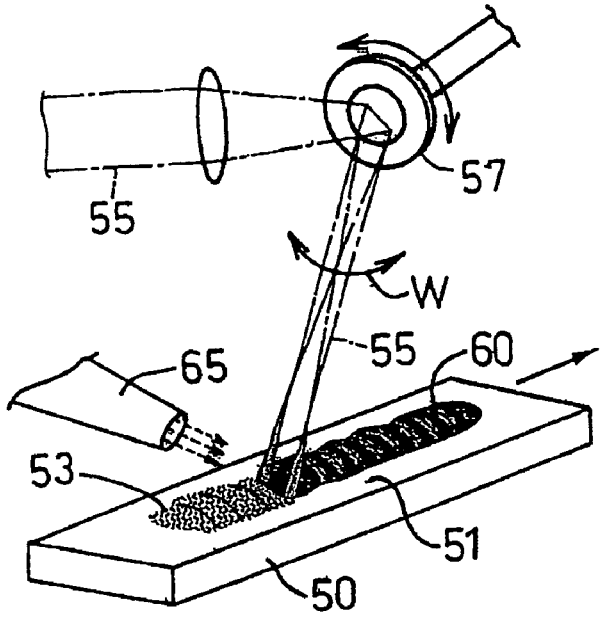
[FIG. 1] This is a perspective view schematically showing that a cladding layer is formed by irradiating a laser beam on a sample layer formed of a wear-resistant copper-based alloy.

The wear-resistant copper-based alloys according to the first and second aspects of the invention can generally obtain a structure in which hard particles having a hard phase are dispersed in a matrix. A typical matrix of the wear-resistant copper-based alloys can mainly comprise a Cu—Ni based solid solution and silicide which includes nickel as a main component.

The hard particles have a higher average hardness than that of the matrix. Generally, the hard particles can include silicide. In addition to the hard particles the matrix can include silicide.

Here, the hard particles can include silicide which mainly comprises one or more of tantalum, titanium, zirconium and hafnium. Also, the hard particles can include silicide which mainly comprises one or more of molybdenum, tungsten, vanadium, tantalum, titanium, zirconium and hafnium. Moreover, the hard particles can include silicide which mainly comprises one or more of molybdenum, tungsten and vanadium and one or more of tantalum, titanium, zirconium and hafnium.

In the wear-resistant copper-based alloy of the present invention, generally the matrix in which the hard particles are dispersed can have an average micro Vickers hardness of about Hv 130 to 250, especially Hv 150 to 200. The hard particles can have an average hardness of about Hv 250 to 700, especially Hv 300 to 500, which is higher than that of the matrix. The volume ratio of the hard particles can be appropriately selected and, for instance, can be about 5 to 70%, 10 to 60%, or 12 to 55% by volume, when the volume of the wear-resistant copper-based alloy is assumed as 100%. The particle diameter of the hard particles depends on the composition of the wear-resistant copper-based alloy, the solidifying speed of the wear-resistant copper-based alloy and soon. In general, the particle diameter can be 5 to 3000 μm, 10 to 2000 μm or 40 to 600 μm, and more particularly can be 50 to 500 μm or 50 to 200 μm, but is not limited to these ranges.

An explanation will be made as to why the composition of the wear-resistant copper-based alloy according to the present invention has been determined.

Nickel: 4.7 to 22.0%, especially 5.0 to 20.0%

Part of nickel dissolves in solid copper to enhance toughness of a copper-based matrix. Another part of nickel forms hard silicide which mainly comprises nickel and enhances wear resistance owing to strengthening by the silicide dispersion. Nickel is also expected to form a hard phase of hard particles together with cobalt, iron, etc. Below the lower limit of the abovementioned content, characteristics of copper-nickel based alloys, in particular, favorable corrosion resistance, heat resistance and wear resistance are hardly exhibited, and the hard particles decrease and the abovementioned effects cannot be obtained sufficiently. Moreover, the amounts of cobalt and/or iron to be added decrease. Above the upper limit of the abovementioned content, the hard particles are excessive, which results in a decrease in toughness, easy cracking when the resultant alloy is formed into a cladding layer, and poor cladding operability when the resultant alloy is clad on a target object. In consideration of the abovementioned circumstances, the nickel content is set in the range from 4.7 to 22.0%, especially 5.0 to 20.0%. For example, the nickel content can be 5.3 to 18%, especially 5.5 to 17.0%. In accordance with the degree of importance of various characteristics desired for the wear-resistant copper-based alloy according to the present invention, the lower limit of the abovementioned nickel content range can be exemplified by 5.2%, 5.5%, 6.0%, 6.5% and 7.0% and the upper limits corresponding to these lower limits can be exemplified by 19.5%, 19.0%, 18.5% and 18.0%, but the nickel content is not restricted within these limits.

Silicon: 0.5 to 5.0%

Silicon is an element forming silicide. Silicon forms silicide which mainly comprises nickel, or silicide which mainly comprises tantalum, titanium, zirconium and/or hafnium, and contributes to strengthening of the copper-base matrix.

Below the lower limit of the abovementioned silicon content, the abovementioned effects cannot be obtained sufficiently. Above the upper limit of the abovementioned content, the resultant wear-resistant copper-based alloy deteriorates in terms of toughness, cracking tends to occur more easily when the alloy is formed into a cladding layer and cladding operability on a target object deteriorates. In consideration of the above circumstances, the silicon content is set in the range from 0.5 to 5.0%. For example, the silicon content can be 1.0 to 4.0%, especially 1.5 to 3.0%. In accordance with the degree of importance of various characteristics desired for the wear-resistant copper-based alloy according to the present invention, the lower limit of the abovementioned silicon content range can be exemplified by 0.55%, 0.6%, 0.65% and 0.7% and the upper limits corresponding to these lower limits can be exemplified by 4.5%, 4.0%, 3.8% and 3.0%, but the silicon content is not restricted within these limits.

Cobalt: 0.01 to 2.00%

Cobalt hardly dissolves in solid copper and forms silicide together with tantalum, titanium, zirconium and/or hafnium and serves to stabilize the silicide. Cobalt in an amount of up to 2.00% forms a solid solution with nickel, iron, chromium or the like and shows a tendency to improve toughness. Cobalt also increases a liquid phase separation tendency in a molten state. It is supposed that mainly a liquid phase which has been separated from a liquid phase portion to become a matrix forms hard particles. Below the lower limit of the abovementioned content, there is a high possibility that the abovementioned effects cannot be obtained sufficiently. When the cobalt content is 0%, crack sensibility is high.

Above the upper limit of the abovementioned cobalt content, coarseness of the hard phase sharply increases, which results in an increase in aggressiveness against a mating member, poor toughness of the resultant wear-resistant copper-based alloy and easy cracking when the resultant alloy is clad on a target object. In consideration of the abovementioned circumstances, the cobalt content is set in the range from 0.01 to 2.00%. For example, the cobalt content can be 0.01 to 1.97%, 0.01 to 1.94%, 0.20 to 1.90%, especially 0.40 to 1.85%. In accordance with the degree of importance of various characteristics desired for the wear-resistant copper-based alloy according to the present invention, the upper limit of the abovementioned cobalt content range can be exemplified by 1.90%, 1.80%, 1.60%, 1.50% and the lower limits corresponding to these upper limits can be exemplified by 0.02%, 0.03%, 0.05%, but the cobalt content is not restricted within these limits.

Iron: 2.7 to 22.0%, especially 3.0 to 20.0%

Iron operates similarly to cobalt and can replace expensive cobalt. Iron hardly dissolves in a copper-based matrix and tends to exist mainly in the hard particles as silicide which includes at least one of iron, tantalum, titanium, zirconium and hafnium. The iron content is set in the range from 2.7 to 22.0%, especially 3.0 to 20.0% in order to generate a large amount of the abovementioned silicide. Below the lower limit of the abovementioned content, the hard particles decrease, wear resistance deteriorates and the abovementioned effects cannot be obtained sufficiently. Above the upper limit of the abovementioned content, coarseness of the hard phase in the hard particles sharply increases, which results in poor crack resistance of the resultant wear-resistant copper-based alloy and an increase in aggressiveness against a mating member. In consideration of the abovementioned circumstances, the iron content is set in the range from 2.7 to 22.0%, especially 3.0 to 20.0% as mentioned before. For example, the iron content can be 3.1 to 19.0%, especially 3.5 to 18.0%. In accordance with the degree of importance of various characteristics desired for the wear-resistant copper-based alloy according to the present invention, the upper limit of the abovementioned iron content range can be exemplified by 21.0%, 19.0%, 18.0% and 16.0%, and the lower limits of the iron content corresponding to these upper limits can be exemplified by 3.0% and 3.3%, but the iron content is not restricted within these limits.

Chromium: 1.0 to 15.0%

Basically, chromium serves similar functions to those of iron and cobalt. Chromium hardly dissolves in a solid copper-based matrix and forms an alloy together with part of nickel and/or part of cobalt so as to improve resistance to oxidation. Moreover, chromium exists in a hard phase and increases a liquid phase separation tendency in a molten state. Below the lower limit of the abovementioned content, the abovementioned effects cannot be obtained sufficiently. Above the upper limit of the abovementioned content, coarseness of the hard phase sharply increases, which results in an increase in aggressiveness against a mating member. In consideration of the abovementioned circumstances, the chromium content is set in the range from 1.0 to 15.0%. For example, the chromium content can be 1.0 to 10.0%, especially 1.1 to 8.0%. In accordance with the degree of importance of various characteristics desired for the wear-resistant copper-based alloy according to the present invention, the lower limit of the abovementioned chromium content range can be exemplified by 1.1% and 1.2% and the upper limits corresponding to these lower limits can be exemplified by 7.0%, 6.0%, 4.0% and 3.0%, but the chromium content is not restricted within these limits.

One or more of tantalum, titanium, zirconium and hafnium: 2.7 to 22.0%, especially 3.0 to 20.0%

Tantalum, titanium, zirconium and/or hafnium as well as molybdenum, tungsten and vanadium combine with silicon to generate silicide (generally silicide having toughness) in the hard particles and enhance wear resistance and lubricity at high temperatures. This silicide has lower hardness and higher toughness than those of silicide of Co—Mo. Accordingly, this silicide which is generated in the hard particles enhances wear resistance and lubricity at high temperatures. It is supposed that tantalum, titanium, zirconium and/or hafnium can form both a Laves phase and carbide in the hard particles. The above silicide which mainly comprises tantalum, titanium, zirconium and/or hafnium easily generates an oxide with excellent solid lubricity even in a relatively low temperature range of about 500 to 700° C. and even under a low oxygen partial pressure. In use, this oxide covers a surface of the copper-based matrix and advantageously avoids direct contact between a mating member and the matrix. This secures self lubricity.

When one or more of tantalum, titanium, zirconium and hafnium is contained below the lower limit of the abovementioned content, wear resistance deteriorates and the improving effects cannot be exhibited sufficiently. Above the upper limit, the hard particles are excessive, which results in poor toughness, a decrease in crack resistance and easy cracking. In consideration of the abovementioned circumstances, the content is set in the range from 2.7 to 22.0%, especially 3.0 to 20.0%. For example, the content can be 3.0 to 19.0%, especially 3.0 to 18.0%. In accordance with the degree of importance of various characteristics desired for the wear-resistant copper-based alloy according to the present invention, the lower limit of the abovementioned content range of one or more of tantalum, titanium, zirconium and hafnium can be exemplified by 3.2% and 4.0% and the upper limits corresponding to these lower limits can be exemplified by 18.0%, 17.0% and 16.0%, but the content is not restricted within these limits.

It is possible to include one or more of molybdenum, tungsten and vanadium together with one or more of tantalum, titanium, zirconium and hafnium. In this case, basically similar effects can be obtained. The content of one or more of molybdenum, tungsten, vanadium, tantalum, titanium, zirconium, hafnium, molybdenum, tungsten and vanadium can be 2.7 to 22%, especially 3.0 to 22.0%.

Here, the total content of one or more of molybdenum, tungsten and vanadium and one or more of tantalum, titanium, zirconium and hafnium can be 2.7 to 22.0%.

One or more of molybdenum carbide, tungsten carbide, vanadium carbide, chromium carbide, tantalum carbide, titanium carbide, zirconium carbide and hafnium carbide: 0.01 to 5.0%

These carbides are expected to serve the function of generating nuclei of the hard particles and supposed to contribute to refinement of the hard particles and simultaneous attainment of crack resistance and wear resistance. These carbides can be a single carbide, which is a carbide of one element, or a compound carbide, which is a carbide of a plurality of elements. When the aforementioned carbides are contained below the lower limit of the aforementioned content, the improving effects are not obtained sufficiently. Above the upper limit of the aforementioned content, the resultant alloy shows a tendency to damage crack resistance. In consideration of the aforementioned circumstance, the content is set in the range from 0.01 to 5.0%. Preferably, the content can be 0.01 to 4.5%, 0.05 to 4.0% and more preferably 0.05 to 3.0%, 0.05 to 2.0%. In accordance with the degree of importance of various characteristics desired for the wear-resistant copper-based alloy according to the present invention, the upper limit of the abovementioned content of the above carbides can be exemplified by 4.7%, 3.0%, 2.5% and 2.0% and the lower limits corresponding to these upper limits can be exemplified by 0.02%, 0.04% and 0.1%, but the content is not restricted within these limits. Niobium carbide can be contained together with the above carbides. It is to be noted that the above carbides are included when necessary and that the alloy of the present invention can contain none of the aforementioned carbides.

The wear-resistant copper-based alloy according to the present invention can adopt at least one of the following modes for carrying out the present invention.

The wear-resistant copper-based alloy according to the present invention can be used, for example, as an alloy to be clad on a target object. An example of cladding processes is to melt the alloy into a cladding layer by using such a high-density energy heat source as a laser beam, an electron beam and an arc. For cladding, the wear-resistant cooper-base alloy according to the present invention can be made into powder or a bulk body as a cladding material, and while deposited on a portion to be clad, the powder or the bulk body can be melted into a cladding layer by using a heat source, typically the abovementioned high-density energy heat source such as a laser beam, an electron beam and an arc. The abovementioned wear-resistant copper-based alloy can be prepared as a cladding material not only in the form of powder or a bulk body but also in the form of wire or rods. The laser beam can be exemplified by a carbon dioxide gas laser beam and a YAG laser beam, which have a high energy density. The material of the target object to be clad can be exemplified by aluminum, aluminum-based alloys, iron, iron-based alloys, copper and copper-based alloys. An example of the basic composition of the aluminum alloy to constitute a target object is an aluminum alloy for casting, for instance, an Al—Si based alloy, an Al—Cu based alloy, an Al—Mg based alloy, and an Al—Zn based alloy. Examples of the target object include an engine such as an internal combustion engine and an external combustion engine. In the case of the internal combustion engine, the target object can be, for example, valve train components. In this case, the alloy can be applied to valve seats to constitute exhaust ports or valve seats to constitute inlet ports. In this case, the wear-resistant copper-based alloy according to the present invention can constitute the entire part of valve seats or can be clad on valve seats. However, it is to be noted that the wear-resistant copper-based alloy according to the present invention is not limited to materials for valve train components for such an engine as an internal combustion engine and can be applied to sliding materials, sliding members and sintered members of other systems which demand wear resistance.

When used for cladding, the wear-resistant copper-based alloy according to the present invention can constitute a cladding layer after a cladding operation or can be an alloy for cladding before a cladding operation.

The wear-resistant copper-based alloy according to the present invention can be applied, for example, to copper-based sliding members or sliding portions and, more concretely, can be applied to materials for copper-based valve train components to be attached to an internal combustion engine. The wear-resistant copper-based alloy according to the present invention can be used for the purposes of cladding, casting and sintering.

PREFERRED EMBODIMENTS OF THE INVENTION

Example 1

Hereinafter, Example 1 of the present invention will be concretely described together with reference examples. The composition (analytical composition) of A-series samples (*A means containing tantalum) of wear-resistant copper-based alloys used in Example 1 is shown in Table 1. Analytical composition basically comes in consistency with mixing composition. The composition of Example 1 has the cobalt content of not more than 2%, includes tantalum, and is set to comprise, by weight, 4.7to22.0% nickel, 0.5 to 5.0% silicon, 2.7 to 22.0% iron, 1.0 to 15.0% chromium, 0.01 to 2.00% cobalt, 2.7 to 22.0% tantalum, and the balance of copper, as shown in Table 1. Sample i, Simple a, Sample c, Sample e, Sample g, and Sample x shown in Table 1 fall outside the compositional range of claim 1 and indicate reference examples because these samples include molybdenum but do not include tantalum, titanium, zirconium, or hafnium.

The respective aforementioned samples are powders produced by gas atomizing molten metal under a high vacuum. The powders have a grain size of about 5 μm to 300 μm. The gas atomization was carried out by spraying high temperature molten metal from a nozzle under a non-oxidizing atmosphere (an argon gas atmosphere or a nitrogen gas atmosphere). Owing to the production by gas atomization, the abovementioned powders have high component uniformity.

As shown in FIG. 1, a substrate 50 formed of an aluminum alloy (material: AC2C) was used as a target object to be clad. With a sample layer 53 formed by placing each of the abovementioned powdery samples on a portion 51 of the substrate 50 to be clad, a laser beam 55 of a carbon dioxide gas laser was oscillated by a beam oscillator 57 and at the same time, the laser beam 55 and the substrate 50 were moved relative to each other, whereby the laser beam 55 was irradiated on the sample layer 53. Thus, the sample layer 53 was melted and then solidified so as to form a cladding layer 60 (cladding thickness: 2.0 mm, cladding width: 6.0 mm) on the portion 51 of the substrate 50 to be clad.

This cladding operation was carried out while a shielding gas (an argon gas) was blown from a gas supply pipe 65 to a region to be clad. In the abovementioned irradiation treatment, the laser beam 55 was oscillated in the width direction (the direction of Arrow W) of the sample layer 53 by the beam oscillator 57. In the above irradiation treatment, the carbon dioxide gas laser had a power of 4.5 kW, the spot diameter of the laser beam 55 at the sample layer 53 was 2.0 mm, the relative moving speed of the laser beam 55 and the substrate 50 was 15.0 mm/sec, and the shielding gas flow rate was 10 liter/min. Similarly, cladding layers were respectively formed of other samples.

An examination of the cladding layers formed of the respective samples showed that hard particles having a hard phase were dispersed in the matrixes of the cladding layers. The volume ratio of the hard particles in each of the wear-resistant copper-based alloys fell in the range from about 5 to 60% when the wear-resistant copper-based alloy was assumed as 100%. The average hardness of the matrix, the average hardness of the hard particles and the diameter of the hard particles were in the aforementioned ranges.

Figure 2:
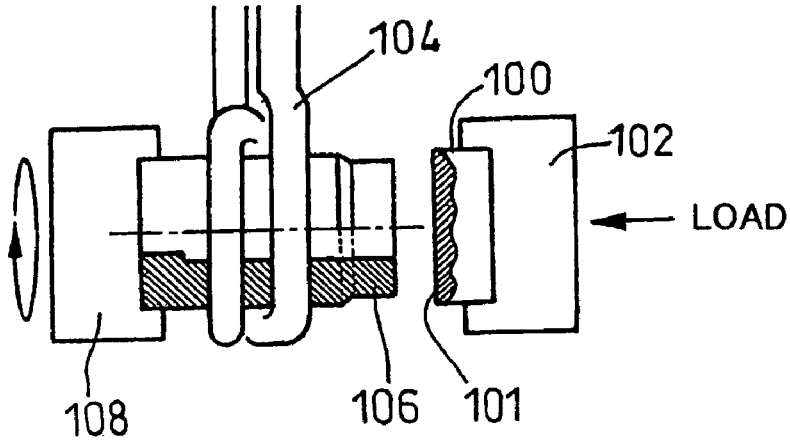
[FIG. 2] This is a configurational view schematically showing that a wear resistance test is conducted on a test piece with a cladding layer.

Crack rates during cladding operations were examined on the cladding layers formed by using the respective samples. An abrasion test was also carried out to measure weight loss by abrasion of the cladding layers formed by using the respective samples. As shown in FIG. 2, the abrasion test was carried out as follows: A test piece 100 having a cladding layer 101 was held by a first holder 102. On the other hand, with an inductive coil 104 wound around its outer circumstance, a cylindrical mating member 106 was held by a second holder 108 and heated by high frequency induction heating by the inductive coil 104, and at the same time the mating member 106 was rotated and an axial end surface of the mating member 106 was pressed against the cladding layer 101 of the test piece 100. As for test conditions, the load was 2.0 MPa, the sliding speed was 0.3 m/sec., the test time was 1.2 ksec., and the surface temperature of the test piece 100 was 323 to 523 K. The mating member 106 used was a JIS-SUH35 equivalent whose surface was covered with a wear-resistant stellite alloy. Furthermore, a cutting test was carried out to examine machinability of the cladding layers formed by using the respective samples. The cutting test was evaluated by the number of cylinder heads having the cladding layers thereon cut by a single cutting tool.

Table 1 shows not only the composition of the respective samples but also the crack rates (%) of the cladding layers during the cladding operation, the weight loss (mg) by abrasion of the cladding layers in the abrasion test, and the test results on machinability of the cladding layers (the number of heads cut) in the cutting test. Here, a smaller crack rate means better crack resistance. A smaller weight loss by abrasion means better wear resistance. A greater number of heads cut means better machinability.

Sample i, Sample a, Sample c, Sample e, Sample g, Sample x of Reference Examples could enhance wear-resistance in a high temperature range, crack resistance and machinability in a balanced manner because the limitation of the cobalt content to not more than 2% could reduce or delete hard and brittle silicide of Co—Mo and could increase the ratio of silicide which has lower hardness and slightly higher toughness than those of silicide of Co—Mo.

However, there have been severer demands for characteristics recently, and it has been requested to further enhance wear resistance, crack resistance and machinability in a balanced manner. As shown in Table 1, Sample i of Reference Examples had a small weight loss by abrasion and good machinability but did not have sufficient crack resistance. Sample a of Reference Examples had a small weight loss by abrasion but did not have sufficient crack resistance or machinability. Sample c and Sample g of Reference Examples had good crack resistance and machinability but had large weight losses by abrasion.

In contrast to these samples, the cladding layers formed of the respective samples according to Example 1 had low crack rates of 0% and showed favorable crack resistance. Regardless of the change in the tantalum content, the crack rates remained 0%, that is to say, the crack resistance was favorable.

As for weight loss by abrasion, the cladding layers formed of Sample c and Sample g of Reference Examples showed some effect of improving wear resistance but did not show sufficient wear resistance, indicated by the still large weight losses by abrasion exceeding 10 mg. In contrast to these, the cladding layers formed of the samples according to Example 1 showed excellent effect of improving wear resistance, as indicated by as small weight loss by abrasion as not more than 10 mg. Especially, the cladding layers formed of Sample A2 and Sample A7 had low weight losses by abrasion.

As for machinability, the cladding layer formed of Sample a of Reference Examples had a small number of cylinder heads cut, that is to say, insufficient machinability. The cladding layers formed of the samples of Example 1, however, had small weight losses by abrasion, i.e., favorable wear resistance. Accordingly, it is understood from the test results shown in Table 1 that the cladding layers formed of the wear-resistant copper-based alloys of the respective samples of Example 1 could obtain crack resistance, wear resistance and machinability in a balanced manner, and that these cladding layers could obtain especially favorable crack resistance.

Example 2

Hereinafter, Example 2 of the present invention will be described concretely. In Example 2, cladding layers were formed under basically the same conditions as those of Example 1. The composition of T-series samples (*T means containing titanium) of wear-resistant copper-based alloys used in Example 2 is shown in Table 1. The composition of Example 2 has the cobalt content of not more than 2%, includes titanium, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% titanium, and the balance of copper, as shown in Table 1.

An examination of the cladding layers formed of the respective samples showed that hard particles having a hard phase were dispersed in the matrixes of the cladding layers. The volume ratio of the hard particles in each of the wear-resistant copper-based alloys fell in the range from about 5 to 60% when the wear-resistant copper-based alloy was assumed as 100%. The average hardness of the matrix, the average hardness of the hard particles and the diameter of the hard particles were in the aforementioned ranges.

As shown in Table 2, as for crack rates, the cladding layers formed of the samples of Example 2 had low crack rates of 0%. Regardless of the change in the titanium content, the crack rates remained 0%.

As for weight loss by abrasion, the cladding layers formed of the samples of Example 2 had small weight losses by abrasion of 8 mg or less. Especially, the cladding layers formed of Sample T2 and Sample T7 had small weight losses by abrasion. As for machinability, the cladding layers had large numbers of cylinder heads cut, that is to say, sufficient machinability. Accordingly, it is understood from the test results shown in Table 2 that the cladding layers formed of the wear-resistant copper-based alloys of the respective samples of Example 2 could obtain crack resistance, wear resistance and machinability in a balanced manner, and that these cladding layers could obtain especially favorable crack resistance.

Example 3

Hereinafter, Example 3 of the present invention will be described concretely. In Example 3, cladding layers were formed under basically the same conditions as those of Examples 1. The composition of Z-series samples (*Z means containing zirconium) of wear-resistant copper-based alloys used in Example 3 is shown in Table 3. The composition of Example 3 has the cobalt content of not more than 2%, includes zirconium, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% zirconium, and the balance of copper, as shown in Table 3.

As shown in Table 3, as for crack rates, the cladding layers formed of the samples of Example 3 had low crack rates of 0%. Regardless of the change in the zirconium content, the crack rates remained 0%. As for weight loss by abrasion, the cladding layers formed of the samples of Example 3 had small weight losses by abrasion of 9 mg or less. Especially, the cladding layers formed of Sample Z2 and Sample Z7 had small weight losses by abrasion. As for machinability, the cladding layers had large numbers of cylinder heads cut, that is to say, sufficient machinability. Accordingly, it is understood from the test results shown in Table 3 that the cladding layers formed of the wear-resistant copper-based alloys of the respective samples of Example 3 could obtain crack resistance, wear resistance and machinability in a balanced manner, and that these cladding layers could obtain especially favorable crack resistance.

Example 4

Hereinafter, Example 4 of the present invention will be described concretely. In Example 4, cladding layers were formed under basically the same conditions as those of Example 1. The composition of H-series samples (*H means containing hafnium) of wear-resistant copper-based alloys used in Example 4 is shown in Table 4. The composition of Example 4 has the cobalt content of not more than 2%, includes hafnium, and is set to comprise, by weight, 4.7 to 22.0% nickel, 0. 5 to 5.0% silicon, 2.7 to 22.0% iron, 1.0 to 15.0% chromium, 0.01 to 2.00% cobalt, 2.7 to 22.0% hafnium, and the balance of copper, as shown in Table 4.

As shown in Table 4, as for crack rates, the cladding layers formed of the samples of Example 4 had low crack rates of 0%. Regardless of the change in the hafnium content, the crack rates remained 0%. As for weight loss by abrasion, the cladding layers formed of the samples of Example 4 had small weight losses by abrasion of 7 mg or less. Especially, the cladding layers formed of Sample H2, Sample H6 and Sample H7 had small weight losses by abrasion. As for machinability, the cladding layers had large numbers of cylinder heads cut, that is to say, sufficient machinability. Accordingly, it is understood from the test results shown in Table 4 that the cladding layers formed of the wear-resistant copper-based alloys of the respective samples of Example 4 could obtain crack resistance, wear resistance and machinability in a balanced manner, and that these cladding layers could obtain especially favorable crack resistance.

Example 5

Hereinafter, Example 5 of the present invention will be described concretely. In Example 5, cladding layers were formed under basically the same conditions as those of Example 1. The composition of WC-series samples (*WC means containing tungsten carbide) of wear-resistant copper-based alloys used in Example 5 is shown in Table 5. The composition of Example 5 has the cobalt content of not more than 2%, includes tungsten and tungsten carbide, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% tungsten, 0.01 to 5.0% (1.2%) tungsten carbide and the balance of copper, as shown in Table 5.

As shown in Table 5, as for crack rates, the cladding layers formed of the samples of Example 5 had low crack rates of 0%. Regardless of the change in the tungsten content and the tungsten carbide content, the crack rates remained 0%. As for weight loss by abrasion, the cladding layers formed of the samples of Example 5 had small weight losses by abrasion of 8 mg or less. Especially, the cladding layers formed of Sample WC1 and Sample WC7 had small weight losses by abrasion. As for machinability, the cladding layers had large numbers of cylinder heads cut, that is to say, sufficient machinability. Accordingly, it is understood from the test results shown in Table 5 that the cladding layers formed of the wear-resistant copper-based alloys of the respective samples of Example 5 could obtain crack resistance, wear resistance and machinability in a balanced manner, and that these cladding layers could obtain especially favorable crack resistance.

Example 6

Hereinafter, Example 6 of the present invention will be described concretely. In Example 6, cladding layers were formed under basically the same conditions as those of Example 1. The composition of AC-series samples (*AC means containing tantalum carbide) of wear-resistant copper-based alloys used in Example 6 is shown in Table 6. The composition of Example 6 has the cobalt content of not more than 2%, includes tantalum and tantalum carbide, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% tantalum, 0.01 to 5.0% (1.2%) tantalum carbide and the balance of copper, as shown in Table 6.

As shown in Table 6, as for crack rates, the cladding layers formed of the samples of Example 6 had low crack rates of 0%. Regardless of the change in the tantalum content and the tantalum carbide content, the crack rates remained 0%. As for weight loss by abrasion, the cladding layers formed of the samples of Example 6 had small weight losses by abrasion of 8 mg or less. Especially, the cladding layers formed of Sample AC2 and Sample AC7 had small weight losses by abrasion. As for machinability, the cladding layers had large numbers of cylinder heads cut, that is to say, sufficient machinability. Accordingly, it is understood from the test results shown in Table 6 that the cladding layers formed of the wear-resistant copper-based alloys of the respective samples of Example 6 could obtain crack resistance, wear resistance and machinability in a balanced manner, and that these cladding layers could obtain especially favorable crack resistance.

Example 7

Hereinafter, Example 7 of the present invention will be described concretely. In Example 7, cladding layers were formed under basically the same conditions as those of Example 1. The composition of TC-series samples (*TC means containing titanium carbide) of wear-resistant copper-based alloys used in Example 7 is shown in Table 7. The composition of Example 7 has the cobalt content of not more than 2%, includes titanium and titanium carbide, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% titanium, 0.01 to 5.0% (1.2%) titanium carbide and the balance of copper, as shown in Table 5.

As shown in Table 7, as for crack rates, the cladding layers formed of the samples of Example 7 had low crack rates of 0%. Regardless of the change in the titanium content and the titanium carbide content, the crack rates remained 0%. As for weight loss by abrasion, the cladding layers formed of the samples of Example 7 had small weight losses by abrasion of 10 mg or less. Especially, the cladding layers formed of Sample TC2 and Sample TC7 had small weight losses by abrasion. As for machinability, the cladding layers had large numbers of cylinder heads cut, that is to say, sufficient machinability. Accordingly, it is understood from the test results shown in Table 7 that the cladding layers formed of the wear-resistant copper-based alloys of the respective samples of Example 7 could obtain crack resistance, wear resistance and machinability in a balanced manner, and that these cladding layers could obtain especially favorable crack resistance.

Example 8

Hereinafter, Example 8 of the present invention will be described concretely. In Example 8, cladding layers were formed under basically the same conditions as those of Example 1. The composition of ZC-series samples (*ZC means containing zirconium carbide) of wear-resistant copper-based alloys used in Example 8 is shown in Table 8. The composition of Example 8 has the cobalt content of not more than 2%, includes zirconium and zirconium carbide, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% zirconium, 0.01 to 5.0% (1.2%) zirconium carbide and the balance of copper, as shown in Table 8.

As shown in Table 8, as for crack rates, the cladding layers formed of the samples of Example 8 had low crack rates of 0%. Regardless of the change in the zirconium content and the zirconium carbide content, the crack rates remained 0%. As for weight loss by abrasion, the cladding layers formed of the samples of Example 8 had small weight losses by abrasion of 10 mg or less. Especially, the cladding layers formed of Sample ZC2 and Sample ZC7 had small weight losses by abrasion. As for machinability, the cladding layers had large numbers of cylinder heads cut, that is to say, sufficient machinability. Accordingly, it is understood from the test results shown in Table 7 that the cladding layers formed of the wear-resistant copper-based alloys of the respective samples of Example 7 could obtain crack resistance, wear resistance and machinability in a balanced manner, and that these cladding layers could obtain especially favorable crack resistance.

Example 9

Hereinafter, Example 9 of the present invention will be described concretely. In Example 9, cladding layers were formed under basically the same conditions as those of Example 1. The composition of HC-series samples (*HC means containing hafnium carbide) of wear-resistant copper-based alloys used in Example 9 is shown in Table 9. The composition of Example 9 has the cobalt content of not more than 2%, includes hafnium and hafnium carbide, and is set to comprise, by weight, 4.7 to 22.0% nickel, 0.5 to 5.0% silicon, 2.7 to 22.0% iron, 1.0 to 15.0% chromium, 0.01 to 2.00% cobalt, 2.7 to 22.0% hafnium, 0.01 to 5.0% (1.2%) hafnium carbide and the balance of copper, as shown in Table 9.

As shown in Table 9, as for crack rates, the cladding layers formed of the samples of Example 9 had low crack rates of 0%. Regardless of the change in the hafnium content and the hafnium carbide content, the crack rates remained 0%. As for weight loss by abrasion, the cladding layers formed of the samples of Example 9 had small weight losses by abrasion of 10 mg or less. Especially, the cladding layers formed of Sample HC2 and Sample HC7 had small weight losses by abrasion. As for machinability, the cladding layers had large numbers of cylinder heads cut, that is to say, sufficient machinability. Accordingly, it is understood from the test results shown in Table 9 that the cladding layers formed of the wear-resistant copper-based alloys of the respective samples of Example 9 could obtain crack resistance, wear resistance and machinability in a balanced manner, and that these cladding layers could obtain especially favorable crack resistance.

TABLE 1

| | | TANTALUM-CONTAINING WEAR-RESISTANT COPPER-BASED ALLOY COMPOSITION % by weight | | | | | | | | CRACK RATE | WEIGHT LOSS BY ABRASION OF VALVE SEAT | MACHINABILITY the number |
|---|---|---|---|---|---|---|---|---|---|---|---|---|
| | SAMPLE | Cu | Ni | Si | Ta | Fe | Cr | Co | | % | mg | of heads cut |
| EX. 1 | A1 | BALANCE | 17.5 | 2.3 | 17.5 | 17.5 | 1.5 | 0.5 | | 0 | 5-7 | 380 |
| | A2 | BALANCE | 20.0 | 2.3 | 20.0 | 20.0 | 1.5 | 0.5 | | 0 | 2-3 | 240 |
| | A3 | BALANCE | 5.5 | 2.3 | 5.5 | 4.5 | 1.5 | 0.5 | | 0 | 9-10 | 430 |
| | A4 | BALANCE | 5.0 | 2.3 | 3.0 | 3.0 | 1.5 | 0.5 | | 0 | 9-10 | 390 |
| | A5 | BALANCE | 18.0 | 2.3 | 8.0 | 10.0 | 1.5 | 0.5 | | 0 | 5-7 | 370 |
| | A6 | BALANCE | 17.5 | 2.3 | 17.5 | 17.5 | 1.5 | 1.8 | | 0 | 3-5 | 350 |
| | A7 | BALANCE | 20.0 | 2.3 | 20.0 | 20.0 | 1.5 | 1.8 | | 0 | 2-3 | 230 |
| | A8 | BALANCE | 5.5 | 2.3 | 5.5 | 4.5 | 1.5 | 1.8 | | 0 | 6-8 | 410 |
| | A9 | BALANCE | 5.0 | 2.3 | 3.0 | 3.0 | 1.5 | 1.8 | | 0 | 7-9 | 380 |
| | A10 | BALANCE | 18.0 | 2.3 | 8.0 | 8.0 | 1.5 | 1.8 | | 0 | 5-7 | 360 |
| REF. EX. | i | BALANCE | 18.0 | 2.3 | Mo 8.0 | 10.0 | 1.5 | 1.0 | | 1.0 | 4-5 | 330 |
| | a | BALANCE | 22.5 | 2.3 | Mo 22.5 | 12.5 | 1.5 | 1.0 | | 1.5 | 2-3 | 180 |
| | c | BALANCE | 12.5 | 2.3 | Mo 12.5 | 22.5 | 1.5 | 1.0 | | 0.20 | 10-12 | 280 |
| | g | BALANCE | 2.5 | 2.3 | Mo 2.5 | 7.5 | 1.5 | 1.0 | | 0 | 12-16 | 370 |
| | x | BALANCE | 18.0 | 2.3 | Mo 8.0 | 10.0 | 1.5 | 1.0 | NbC 1.2 | 0 | 3-4 | 350 |

TABLE 2

| | | TITANIUM-CONTAINING WEAR-RESISTANT COPPER-BASED ALLOY COMPOSITION % by weight | | | | | | | CRACK RATE | WEIGHT LOSS BY ABRASION OF VALVE SEAT | MACHINABILITY the number |
|---|---|---|---|---|---|---|---|---|---|---|---|
| | SAMPLE | Cu | Ni | Si | Ti | Fe | Cr | Co | % | mg | of heads cut |
| EX. 2 | T1 | BALANCE | 17.5 | 2.3 | 17.5 | 17.5 | 1.5 | 0.5 | 0 | 4-5 | 360 |
| | T2 | BALANCE | 20.0 | 2.3 | 20.0 | 20.0 | 1.5 | 0.5 | 0 | 1-2 | 220 |
| | T3 | BALANCE | 5.5 | 2.3 | 5.5 | 4.5 | 1.5 | 0.5 | 0 | 7-8 | 410 |
| | T4 | BALANCE | 5.0 | 2.3 | 3.0 | 3.0 | 1.5 | 0.5 | 0 | 7-8 | 370 |
| | T5 | BALANCE | 18.0 | 2.3 | 8.0 | 10.0 | 1.5 | 0.5 | 0 | 5-6 | 350 |
| | T6 | BALANCE | 17.5 | 2.3 | 17.5 | 17.5 | 1.5 | 1.8 | 0 | 2-3 | 330 |
| | T7 | BALANCE | 20.0 | 2.3 | 20.0 | 20.0 | 1.5 | 1.8 | 0 | 1-2 | 210 |
| | T8 | BALANCE | 5.5 | 2.3 | 5.5 | 4.5 | 1.5 | 1.8 | 0 | 4-6 | 380 |
| | T9 | BALANCE | 5.0 | 2.3 | 3.0 | 3.0 | 1.5 | 1.8 | 0 | 5-7 | 360 |
| | T10 | BALANCE | 18.0 | 2.3 | 8.0 | 8.0 | 1.5 | 1.8 | 0 | 5-6 | 340 |

TABLE 3

| | | ZIRCONIUM-CONTAINING WEAR-RESISTANT COPPER-BASED ALLOY COMPOSITION % by weight | | | | | | | CRACK RATE | WEIGHT LOSS BY ABRASION OF VALVE SEAT | MACHINABILITY the number |
|---|---|---|---|---|---|---|---|---|---|---|---|
| | SAMPLE | Cu | Ni | Si | Zr | Fe | Cr | Co | % | mg | of heads cut |
| EX. 3 | Z1 | BALANCE | 17.5 | 2.3 | 17.5 | 17.5 | 1.5 | 0.5 | 0 | 4-6 | 370 |
| | Z2 | BALANCE | 20.0 | 2.3 | 20.0 | 20.0 | 1.5 | 0.5 | 0 | 1-2 | 230 |
| | Z3 | BALANCE | 5.5 | 2.3 | 5.5 | 4.5 | 1.5 | 0.5 | 0 | 8-9 | 420 |
| | Z4 | BALANCE | 5.0 | 2.3 | 3.0 | 3.0 | 1.5 | 0.5 | 0 | 8-9 | 380 |
| | Z5 | BALANCE | 18.0 | 2.3 | 8.0 | 10.0 | 1.5 | 0.5 | 0 | 4-6 | 360 |
| | Z6 | BALANCE | 17.5 | 2.3 | 17.5 | 17.5 | 1.5 | 1.8 | 0 | 3-4 | 340 |
| | Z7 | BALANCE | 20.0 | 2.3 | 20.0 | 20.0 | 1.5 | 1.8 | 0 | 1-2 | 220 |
| | Z8 | BALANCE | 5.5 | 2.3 | 5.5 | 4.5 | 1.5 | 1.8 | 0 | 5-6 | 400 |
| | Z9 | BALANCE | 5.0 | 2.3 | 3.0 | 3.0 | 1.5 | 1.8 | 0 | 6-8 | 370 |
| | Z10 | BALANCE | 18.0 | 2.3 | 8.0 | 8.0 | 1.5 | 1.8 | 0 | 4-6 | 350 |

TABLE 4

| | | HAFNIUM-CONTAINING WEAR-RESISTANT COPPER-BASED ALLOY COMPOSITION % by weight | | | | | | | CRACK RATE | WEIGHT LOSS BY ABRASION OF VALVE SEAT | MACHINABILITY the number |
|---|---|---|---|---|---|---|---|---|---|---|---|
| | SAMPLE | Cu | Ni | Si | Hf | Fe | Cr | Co | % | mg | of heads cut |
| EX. 4 | H1 | BALANCE | 17.5 | 2.3 | 17.5 | 17.5 | 1.5 | 0.5 | 0 | 3-4 | 350 |
| | H2 | BALANCE | 20.0 | 2.3 | 20.0 | 20.0 | 1.5 | 0.5 | 0 | 1-2 | 210 |
| | H3 | BALANCE | 5.5 | 2.3 | 5.5 | 4.5 | 1.5 | 0.5 | 0 | 6-7 | 400 |
| | H4 | BALANCE | 5.0 | 2.3 | 3.0 | 3.0 | 1.5 | 0.5 | 0 | 6-7 | 360 |

TABLE 4-continued

| | HAFNIUM-CONTAINING WEAR-RESISTANT COPPER-BASED ALLOY COMPOSITION % by weight | | | | | | | CRACK RATE | WEIGHT LOSS BY ABRASION OF VALVE SEAT | MACHINABILITY the number |
|---|---|---|---|---|---|---|---|---|---|---|
| SAMPLE | Cu | Ni | Si | Hf | Fe | Cr | Co | % | mg | of heads cut |
| H5 | BALANCE | 18.0 | 2.3 | 8.0 | 10.0 | 1.5 | 0.5 | 0 | 4-5 | 340 |
| H6 | BALANCE | 17.5 | 2.3 | 17.5 | 17.5 | 1.5 | 1.8 | 0 | 1-2 | 320 |
| H7 | BALANCE | 20.0 | 2.3 | 20.0 | 20.0 | 1.5 | 1.8 | 0 | 1-2 | 210 |
| H8 | BALANCE | 5.5 | 2.3 | 5.5 | 4.5 | 1.5 | 1.8 | 0 | 3-5 | 370 |
| H9 | BALANCE | 5.0 | 2.3 | 3.0 | 3.0 | 1.5 | 1.8 | 0 | 4-6 | 350 |
| H10 | BALANCE | 18.0 | 2.3 | 8.0 | 8.0 | 1.5 | 1.8 | 0 | 4-6 | 330 |

TABLE 5

| | TUNGSTEN & TUNGSTEN CARBIDE-CONTAINING WEAR-RESISTANT COPPER-BASED ALLOY COMPOSITION % by weight | | | | | | | | | CRACK RATE | WEIGHT LOSS BY ABRASION OF VALVE SEAT | MACHINABILITY the number |
|---|---|---|---|---|---|---|---|---|---|---|---|---|
| | SAMPLE | Cu | Ni | Si | W | Fe | Cr | Co | WC | % | mg | of heads cut |
| EX. 5 | WC1 | BALANCE | 17.5 | 2.3 | 17.5 | 17.5 | 1.5 | 0.5 | 1.2 | 0 | 2-3 | 350 |
| | WC2 | BALANCE | 20.0 | 2.3 | 20.0 | 20.0 | 1.5 | 0.5 | 1.2 | 0 | 0.5-1 | 220 |
| | WC3 | BALANCE | 5.5 | 2.3 | 5.5 | 4.5 | 1.5 | 0.5 | 1.2 | 0 | 6-8 | 400 |
| | WC4 | BALANCE | 5.0 | 2.3 | 3.0 | 3.0 | 1.5 | 0.5 | 1.2 | 0 | 6-8 | 370 |
| | WC5 | BALANCE | 18.0 | 2.3 | 8.0 | 10.0 | 1.5 | 0.5 | 1.2 | 0 | 3-4 | 350 |
| | WC6 | BALANCE | 17.5 | 2.3 | 17.5 | 17.5 | 1.5 | 1.8 | 1.2 | 0 | 1-2 | 330 |
| | WC7 | BALANCE | 20.0 | 2.3 | 20.0 | 20.0 | 1.5 | 1.8 | 1.2 | 0 | 0.1-0.5 | 200 |
| | WC8 | BALANCE | 5.5 | 2.3 | 5.5 | 4.5 | 1.5 | 1.8 | 1.2 | 0 | 4-6 | 380 |
| | WC9 | BALANCE | 5.0 | 2.3 | 3.0 | 3.0 | 1.5 | 1.8 | 1.2 | 0 | 4-6 | 350 |
| | WC10 | BALANCE | 18.0 | 2.3 | 8.0 | 8.0 | 1.5 | 1.8 | 1.2 | 0 | 2-3 | 330 |

TABLE 6

| | TANTALUM & TANTALUM CARBIDE-CONTAINING WEAR-RESISTANT COPPER-BASED ALLOY COMPOSITION % by weight | | | | | | | | | CRACK RATE | WEIGHT LOSS BY ABRASION OF VALVE SEAT | MACHINABILITY the number |
|---|---|---|---|---|---|---|---|---|---|---|---|---|
| | SAMPLE | Cu | Ni | Si | Ta | Fe | Cr | Co | TaC | % | mg | of heads cut |
| EX. 6 | AC1 | BALANCE | 17.5 | 2.3 | 17.5 | 17.5 | 1.5 | 0.5 | 1.2 | 0 | 3-4 | 360 |
| | AC2 | BALANCE | 20.0 | 2.3 | 20.0 | 20.0 | 1.5 | 0.5 | 1.2 | 0 | 1-1.5 | 230 |
| | AC3 | BALANCE | 5.5 | 2.3 | 5.5 | 4.5 | 1.5 | 0.5 | 1.2 | 0 | 7-8 | 410 |
| | AC4 | BALANCE | 5.0 | 2.3 | 3.0 | 3.0 | 1.5 | 0.5 | 1.2 | 0 | 7-8 | 380 |
| | AC5 | BALANCE | 18.0 | 2.3 | 8.0 | 10.0 | 1.5 | 0.5 | 1.2 | 0 | 4-5 | 360 |
| | AC6 | BALANCE | 17.5 | 2.3 | 17.5 | 17.5 | 1.5 | 1.8 | 1.2 | 0 | 2-3 | 340 |
| | AC7 | BALANCE | 20.0 | 2.3 | 20.0 | 20.0 | 1.5 | 1.8 | 1.2 | 0 | 0.5-1.0 | 210 |
| | AC8 | BALANCE | 5.5 | 2.3 | 5.5 | 4.5 | 1.5 | 1.8 | 1.2 | 0 | 5-6 | 390 |
| | AC9 | BALANCE | 5.0 | 2.3 | 3.0 | 3.0 | 1.5 | 1.8 | 1.2 | 0 | 5-7 | 360 |
| | AC10 | BALANCE | 18.0 | 2.3 | 8.0 | 8.0 | 1.5 | 1.8 | 1.2 | 0 | 3-4 | 340 |

TABLE 7

| | TITANIUM & TITANIUM CARBIDE-CONTAINING WEAR-RESISTANT COPPER-BASED ALLOY COMPOSITION % by weight | | | | | | | | | CRACK RATE | WEIGHT LOSS BY ABRASION OF VALVE SEAT | MACHINABILITY the number |
|---|---|---|---|---|---|---|---|---|---|---|---|---|
| | SAMPLE | Cu | Ni | Si | Ti | Fe | Cr | Co | TiC | % | mg | of heads cut |
| EX. 7 | TC1 | BALANCE | 17.5 | 2.3 | 17.5 | 17.5 | 1.5 | 0.5 | 1.2 | 0 | 1-1.5 | 330 |
| | TC2 | BALANCE | 20.0 | 2.3 | 20.0 | 20.0 | 1.5 | 0.5 | 1.2 | 0 | 0.5-0.6 | 200 |
| | TC3 | BALANCE | 5.5 | 2.3 | 5.5 | 4.5 | 1.5 | 0.5 | 1.2 | 0 | 4-6 | 380 |
| | TC4 | BALANCE | 5.0 | 2.3 | 3.0 | 3.0 | 1.5 | 0.5 | 1.2 | 0 | 4-6 | 350 |
| | TC5 | BALANCE | 18.0 | 2.3 | 8.0 | 10.0 | 1.5 | 0.5 | 1.2 | 0 | 1-2 | 330 |
| | TC6 | BALANCE | 17.5 | 2.3 | 17.5 | 17.5 | 1.5 | 1.8 | 1.2 | 0 | 1-1.5 | 320 |
| | TC7 | BALANCE | 20.0 | 2.3 | 20.0 | 20.0 | 1.5 | 1.8 | 1.2 | 0 | 0.1-0.3 | 190 |
| | TC8 | BALANCE | 5.5 | 2.3 | 5.5 | 4.5 | 1.5 | 1.8 | 1.2 | 0 | 2-4 | 360 |
| | TC9 | BALANCE | 5.0 | 2.3 | 3.0 | 3.0 | 1.5 | 1.8 | 1.2 | 0 | 3-4 | 330 |
| | TC10 | BALANCE | 18.0 | 2.3 | 8.0 | 8.0 | 1.5 | 1.8 | 1.2 | 0 | 1-1.5 | 310 |

TABLE 8

| | | ZIRCONIUM & ZIRCONIUM-CONTAINING WEAR-RESISTANT COPPER-BASED ALLOY COMPOSITION % by weight | | | | | | | | CRACK RATE | WEIGHT LOSS BY ABRASION OF VALVE SEAT | MACHINABILITY the number |
|---|---|---|---|---|---|---|---|---|---|---|---|---|
| | SAMPLE | Cu | Ni | Si | Zr | Fe | Cr | Co | ZrC | % | mg | of heads cut |
| EX. 8 | ZC1 | BALANCE | 17.5 | 2.3 | 17.5 | 17.5 | 1.5 | 0.5 | 1.2 | 0 | 1-2 | 340 |
| | ZC2 | BALANCE | 20.0 | 2.3 | 20.0 | 20.0 | 1.5 | 0.5 | 1.2 | 0 | 0.5-0.7 | 210 |
| | ZC3 | BALANCE | 5.5 | 2.3 | 5.5 | 4.5 | 1.5 | 0.5 | 1.2 | 0 | 5-7 | 390 |
| | ZC4 | BALANCE | 5.0 | 2.3 | 3.0 | 3.0 | 1.5 | 0.5 | 1.2 | 0 | 5-7 | 360 |
| | ZC5 | BALANCE | 18.0 | 2.3 | 8.0 | 10.0 | 1.5 | 0.5 | 1.2 | 0 | 2-3 | 340 |
| | ZC6 | BALANCE | 17.5 | 2.3 | 17.5 | 17.5 | 1.5 | 1.8 | 1.2 | 0 | 1-1.5 | 320 |
| | ZC7 | BALANCE | 20.0 | 2.3 | 20.0 | 20.0 | 1.5 | 1.8 | 1.2 | 0 | 0.1-0.3 | 190 |
| | ZC8 | BALANCE | 5.5 | 2.3 | 5.5 | 4.5 | 1.5 | 1.8 | 1.2 | 0 | 3-4 | 370 |
| | ZC9 | BALANCE | 5.0 | 2.3 | 3.0 | 3.0 | 1.5 | 1.8 | 1.2 | 0 | 3-5 | 340 |
| | ZC10 | BALANCE | 18.0 | 2.3 | 8.0 | 8.0 | 1.5 | 1.8 | 1.2 | 0 | 1-2 | 320 |

TABLE 9

| | | HAFNIUM & HAFNIUM-CONTAINING WEAR-RESISTANT COPPER-BASED ALLOY COMPOSITION % by weight | | | | | | | | CRACK RATE | WEIGHT LOSS BY ABRASION OF VALVE SEAT | MACHINABILITY the number |
|---|---|---|---|---|---|---|---|---|---|---|---|---|
| | SAMPLE | Cu | Ni | Si | Hf | Fe | Cr | Co | HfC | % | mg | of heads cut |
| EX. 9 | HC1 | BALANCE | 17.5 | 2.3 | 17.5 | 17.5 | 1.5 | 0.5 | 1.2 | 0 | 1-1.5 | 320 |
| | HC2 | BALANCE | 20.0 | 2.3 | 20.0 | 20.0 | 1.5 | 0.5 | 1.2 | 0 | 0.4-0.5 | 190 |
| | HC3 | BALANCE | 5.5 | 2.3 | 5.5 | 4.5 | 1.5 | 0.5 | 1.2 | 0 | 3-5 | 370 |
| | HC4 | BALANCE | 5.0 | 2.3 | 3.0 | 3.0 | 1.5 | 0.5 | 1.2 | 0 | 3-6 | 360 |
| | HC5 | BALANCE | 18.0 | 2.3 | 8.0 | 10.0 | 1.5 | 0.5 | 1.2 | 0 | 1-2 | 320 |
| | HC6 | BALANCE | 17.5 | 2.3 | 17.5 | 17.5 | 1.5 | 1.8 | 1.2 | 0 | 1-1.5 | 310 |
| | HC7 | BALANCE | 20.0 | 2.3 | 20.0 | 20.0 | 1.5 | 1.8 | 1.2 | 0 | 0.1-0.2 | 180 |
| | HC8 | BALANCE | 5.5 | 2.3 | 5.5 | 4.5 | 1.5 | 1.8 | 1.2 | 0 | 2-3 | 340 |
| | HC9 | BALANCE | 5.0 | 2.3 | 3.0 | 3.0 | 1.5 | 1.8 | 1.2 | 0 | 2-4 | 320 |
| | HC10 | BALANCE | 18.0 | 2.3 | 8.0 | 8.0 | 1.5 | 1.8 | 1.2 | 0 | 0.5-1 | 300 |

(Microscopic Observation)

A microscopic observation of the structure of the cladding layer formed of the aforementioned Sample A5 as a present inventive material revealed that a large number of hard particles having a hard phase were dispersed in the entire matrix of the cladding layer. The hard particles had a particle diameter of about 10 to 100 μm. An examination of the above structure by using an EPMA analyzer showed that the hard particles mainly comprised silicide which included iron and tantalum as main components and a Ni—Fe—Cr based solid solution. The matrix constituting the cladding layer mainly comprised a Cu—Ni based solid solution and net-like silicide which included nickel as a main component. The matrix of the cladding layer had a micro Vickers hardness of about Hv 150 to 200. The hard particles had an average hardness of about Hv 300 to 500, which was higher than that of the matrix. The volume ratio of the hard particles fell in the range from about 5 to 60% when the wear-resistant copper-based alloy was assumed as 100%.

It is assumed that each of the wear-resistant copper-based alloys according to the examples of the present invention has a high liquid-phase separation tendency in its molten state, easily generates plural kinds of liquid phases which are hardly mixed with each other, and has a tendency that the separated liquid phases vertically separate from each other owing to a difference in gravity, heat transmission conditions, etc. In this case, it is assumed that when the liquid phase in a granular state rapidly solidifies, the liquid phase in a granular state generates hard particles in a granular state.

A microscopic observation of the structure of the cladding layer formed of the copper-based alloy having the composition of Sample AC5, which included the above carbide (tantalum carbide (TaC)) revealed that a large number of hard particles having a hard phase were dispersed in the entire part of a matrix. The hard particles had a particle diameter of about 10 to 100 μm. An examination of the above structure by using the EPMA analyzer showed that similarly to the above, hard particles mainly comprised silicide which included iron and tantalum as main components and a Ni—Fe—Cr based solid solution. The present inventors have confirmed by using an X-ray diffraction analyzer that the aforementioned silicide constituting the hard particles had a Laves phase.

Figure 3:
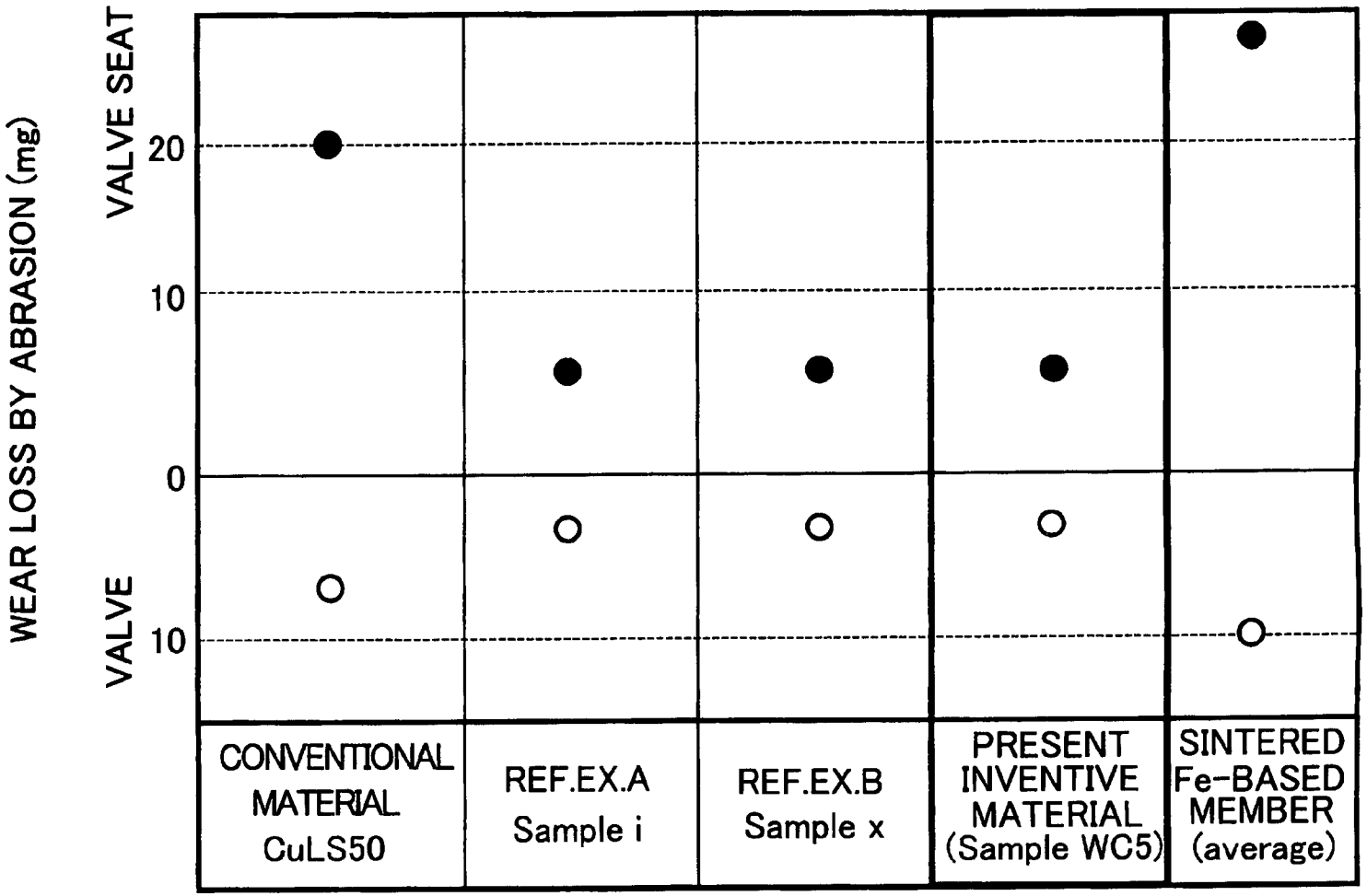
[FIG. 3] This is a graph showing weight loss by abrasion of the cladding layers of the present inventive material, Reference Examples and others.

FIG. 3 shows results of tests on weight loss by abrasion of each of the cladding layers as a self (a valve seat) and weight loss by abrasion of a mating member (a valve). Reference Example A shown in FIG. 3 was based on a cladding layer formed of the wear-resistant copper-based alloy with the composition of Sample i shown in Table 1 by laser beam cladding. Reference Example B was based on a cladding layer formed of the wear-resistant copper-based alloy of Sample x with the composition shown in Table 1 and including 1.2% NbC by laser beam cladding. As mentioned before, % means % by weight in this specification, unless otherwise noted.

As a conventional cobalt-rich material (Model: CuLS50), a cladding layer was formed of an alloy comprising 15% Ni, 2.9% Si, 7% Co, 6.3% Mo, 4.5% Fe, 1.5% Cr and the balance of substantial Cu by a laser beam, and similarly subjected to an abrasion test.

As another comparative example, a test piece was formed of an iron-based sintered member (Composition: the balance of Fe, 0.25 to 0. 55% C, 5.0 to 6.5% Ni, 5.0 to 8.0% Mo, 5.0to 6.5% Cr) and similarly subjected to an abrasion test.

As shown in FIG. 3, the present inventive material (corresponding to Sample WC5) as well as Reference Examples A and B had a small weight loss by abrasion of the self, i.e., the wear-resistant copper-based alloy (the valve seat) and also a small weight loss by abrasion of the mating member (the valve). In contrast to these, the conventional material and the iron-based sintered material had large weight losses by abrasion of the self (the valve seat) and also large weight losses by abrasion of the mating member (the valve).

Cladding layers to act as valve seats were individually formed by employing alloys whose compositions were controlled to have highly wear-resistant composition and lowly wear-resistant composition by adjusting the abovementioned conventional material (Mode: CuLS50), and irradiating a laser beam on the sample layers formed of these alloys. Then these cladding layers were examined about their crack rates. Here, the highly wear-resistant composition means composition aiming an increase in the ratio of a hard phase in the hard particles generating during the cladding operation. The lowly wear-resistant composition means composition aiming a decrease in the ratio of a hard phase in the hard particles generating during the cladding operation. Similarly, cladding layers were individually formed by employing alloys whose compositions were controlled to have highly wear-resistant composition and lowly wear-resistant composition by adjusting Reference Examples 1 and 2, and examined on their crack rates. Similarly, cladding layers were individually formed by employing alloys whose compositions were controlled to have highly wear-resistant composition and lowly wear-resistant composition by adjusting the present inventive material, and examined on their crack rates.

Here, the highly wear-resistant composition of the conventional material comprised the balance of Cu, 20.0% Ni, 2.90% Si, 9.30% Mo, 5.00% Fe, 1.50% Cr and 6.30% Co. The lowly wear-resistant composition of the conventional material comprised the balance of Cu, 16.0% Ni, 2.95% Si, 6.00% Mo, 5.00% Fe, 1.50% Cr and 7.50% Co. The highly wear-resistant composition of Reference Example 1 comprised the balance of Cu, 17.5% Ni, 2.3% Si, 17.5% Mo, 17.5% Fe, 1.5% Cr and 1.0% Co. The lowly wear-resistant composition of Reference Example 1 comprised the balance of Cu, 5.5% Ni, 2.3% Si, 5.5% Mo, 4.5% Fe, 1.5% Cr and 1.0% Co.

The highly wear-resistant composition of Reference Example 2 comprised 17.5% Ni, 2.3% Si, 17.5% Mo, 17.5% Fe, 1.5% Cr, 1.0% Co and 1.2% NbC. The lowly wear-resistant composition of Reference Example 2 comprised 5.5% Ni, 2.3% Si, 5.5% Mo, 4.5% Fe, 1.5% Cr, 1.0% Co and 1.2% NbC.

The highly wear-resistant composition of the present inventive material comprised the balance of Cu, 17.5% Ni, 2.3% Si, 17.5% W, 17.5% Fe, 1.5% Cr, 1.0% Co and 1.2% WC. The lowly wear-resistant composition of the present inventive material comprised the balance of Cu, 5.5% Ni, 2.3% Si, 5.5% W, 4.5% Fe, 1.5% Cr, 1.0% Co and 1.2% WC.

Figure 4:
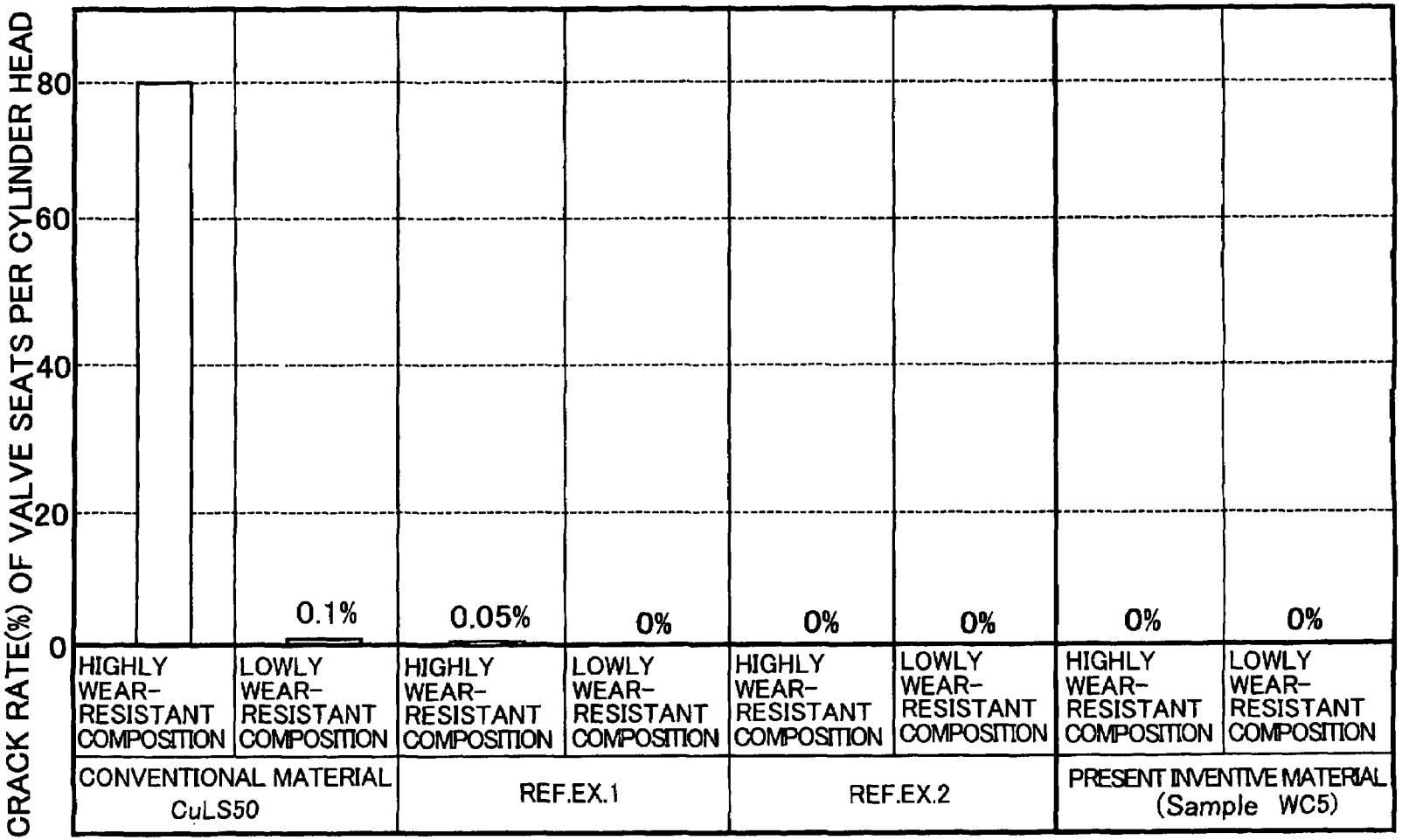
[FIG. 4] This is a graph showing the crack rates of valve seats per cylinder head in the case of the cladding layers formed of the present inventive material, Reference Examples and others.

The test results on crack rates are shown in FIG. 4. As shown in FIG. 4, the crack rate was extremely high on the test piece of the highly wear-resistant composition of the conventional material. On the other hand, the crack rates were as extremely low as 0% on the cladding layers of the highly wear-resistant composition and the lowly wear-resistant composition of Reference Example 1. The crack rates were also as extremely low as 0% on the cladding layers of the highly wear-resistant composition and the lowly wear-resistant composition of Reference Example 2. The crack rates were also as extremely low as 0% on the cladding layers of the highly wear-resistant composition and the lowly wear-resistant composition of the present inventive material (corresponding to Sample WC5).

Moreover, cladding layers to act as valve seats were individually formed on cylinder heads by using alloys whose compositions were respectively controlled by adjusting the abovementioned conventional material, Reference Examples 1 and 2, and the present inventive material to have highly wear-resistant composition and lowly wear-resistant composition and irradiating a laser beam on sample layers formed of the alloys. Then the cladding layers were cut by a cutting tool (a carbide cutting tool) and the number of cylinder heads cut by a single cutting tool was counted. The test results are shown in FIG. 5.

Figure 5:
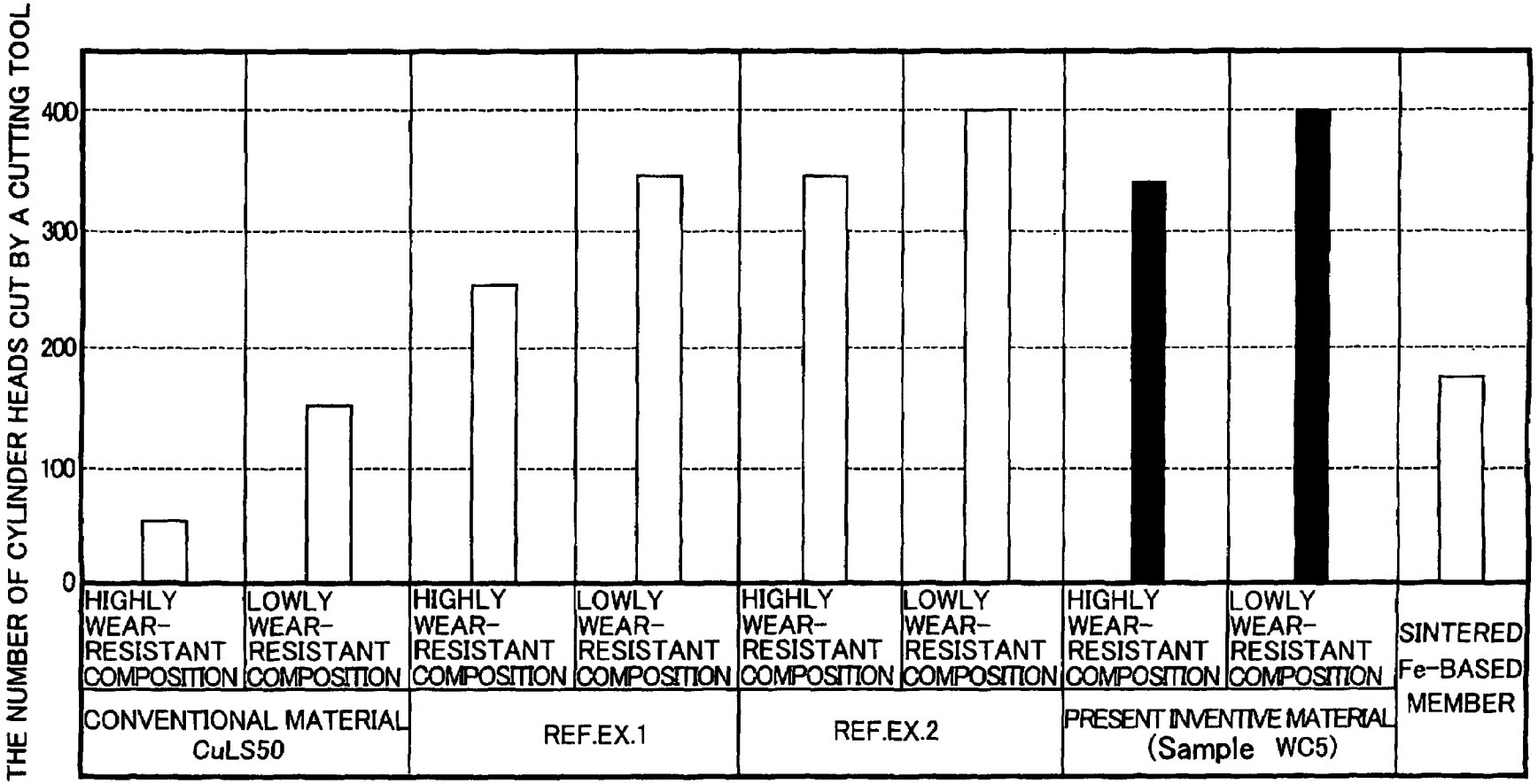
[FIG. 5] This is a graph showing the number of cylinder heads cut by a single cutting tool in the case of the cladding layers formed of the present inventive material, Reference Examples and others.

As shown in FIG. 5, the test piece of the conventional material with the highly wear-resistant composition and that of the conventional material with the lowly wear-resistant composition had small numbers of cylinder heads cut by a single cutting tool, that is to say, poor machinability.

On the other hand, the test piece of Reference Example 1 with the highly wear-resistant composition, that of Reference Example 1 with the lowly wear-resistant composition, that of Reference Example 2 with the highly wear-resistant composition and that of Reference Example 2 with the lowly wear-resistant composition had considerably large numbers of cylinder heads cut by a single cutting tool, that is to say, favorable machinability.

The test piece of the present inventive material with the highly wear-resistant composition and that of the present inventive material with the lowly wear-resistant composition as well as those of References Examples 1 and 2 had considerably large numbers of cylinder heads cut by a single cutting tool, that is to say, favorable machinability. The aforementioned iron-based sintered member was similarly examined about machinability and the number of cylinder heads cut by a single cutting tool was as low as about 180, that is to say, machinability was poor.

The total evaluation of the abovementioned test results shows that if the whole of valves seats, which are components of a valve train for an internal combustion engine, are constituted by cladding layers of the wear-resistant copper-based alloy according to the present invention or valve seats are overlaid by cladding layers of the wear-resistant copper-based alloy according to the present invention, wear resistance of the valve seats can be improved and moreover aggressiveness against mating members can be suppressed and weight loss by abrasion of valves as mating members can be suppressed. Further, this is advantageous in enhancing crack resistance and machinability, and especially advantageous in forming a cladding layer.

(Application Example)

Figure 6:
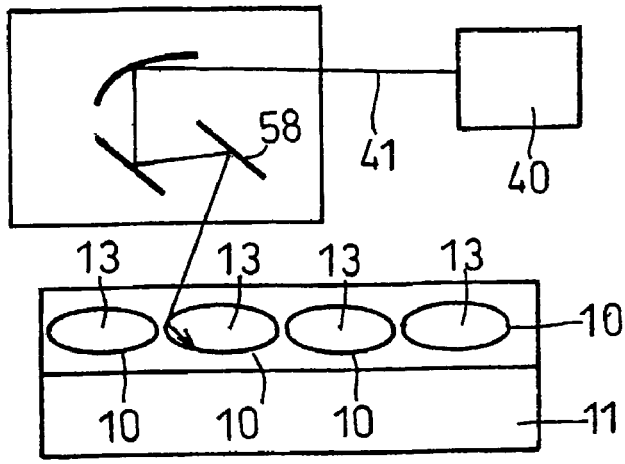
[FIG. 6] This is a diagrammatical view schematically showing a process of forming valve seats of a wear-resistant copper-based alloy on ports of an internal combustion engine by cladding, according to an application example.
Figure 7:
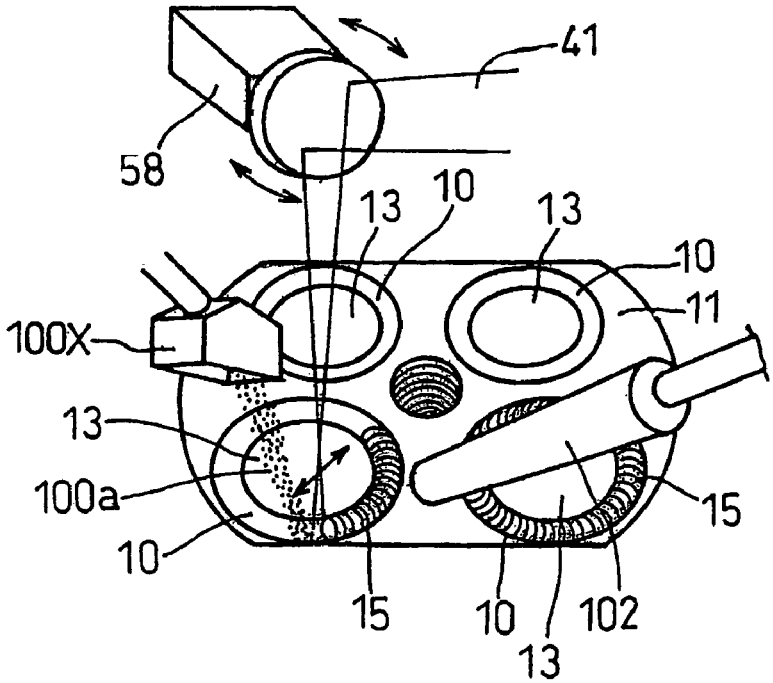
[FIG. 7] This is a perspective view of the relevant parts showing the process of forming the valves seats of the wear-resistant copper-based alloy on the ports of the internal combustion engine according to the application example.

FIG. 6 and FIG. 7 show an application example. In this case, valve seats are formed by cladding a wear-resistant copper-based alloy on ports 13, which communicate with a combustion chamber of a vehicular internal combustion engine 11. In this case, annular peripheral surfaces 10 are formed at inner peripheral portions of the plurality of ports 13, which are formed of an aluminum alloy and communicate with the combustion chamber of the internal combustion engine 11. With a sprayer 100X held near one of the peripheral surfaces 10, a powdery layer is formed by depositing powder 100*a* of the wear-resistant copper-based alloy according to the present invention on the one of the peripheral surfaces 10, and at the same time, a laser beam 41 emitted from a laser emitter 40 and kept oscillated by a beam oscillator 58 is irradiated on the powdery layer. Thus a cladding layer 15 is formed on the one of the peripheral surfaces 10. This cladding layer 15 will act as a valve seat. In the cladding operation, a shielding gas (generally argon gas) is supplied from a gas supply unit 102 to a region to be clad so as to shield the region to be clad.

(Others)

In the abovementioned examples, the powders of the wear-resistant copper-based alloys were formed by gas atomization, but the method of powder formation is not limited to this: Wear-resistant copper-based alloy powder for cladding can be formed by mechanical atomization in which molten metal is crashed against a revolving body to be made into powder, or by mechanical pulverization with the use of a pulverizing apparatus.

In the abovementioned examples, the present invention was applied to valve seats constituting a valve train for a combustion engine, but application of the present invention is not limited to this: In some cases, the present invention can be applied to a material for valves, which act as mating members of valve seats, or to a material to be clad on valves. The internal combustion engine can be a gasoline engine or a diesel engine. In the abovementioned examples, the present invention was applied for cladding, but application of the present invention is not limited to this: In some cases, the present invention can be applied to ingot products or sintered products.

Besides, the present invention is not limited to the examples described above and shown in the figures. Appropriate modification can be made to the working out of the present invention without departing from the scope of the invention. The words and phrases recited in the modes for carrying out the invention and in the examples can be recited in each claim, even if partly. The numerals of the content of each component described in Tables 1 to 9 can be used for definition of an upper limit value or a lower limit value of each component described in claims or appendixes.

The following technical concepts can also be grasped from the above description.

(Appendix 1) A cladding layer formed of the wear-resistant copper-based alloy according to each claim.

(Appendix 2) A cladding sliding member formed of the wear-resistant copper-based alloy according to each claim.

(Appendix 3) A cladding layer or a cladding sliding member according to Appendix 1 or Appendix 2, formed by using a high-density energy heat source selected from a laser beam, an electron beam and an arc.

(Appendix 4) Valve train components (for example, valve seats) for an internal combustion engine having a cladding layer formed of the wear-resistant copper-based alloy according to each claim.

(Appendix 5) A method of producing a sliding member, characteristically using the wear-resistant copper-based alloy according to each claim and cladding the wear-resistant copper-based alloy on a substrate.

(Appendix 6) A method of producing a sliding member, characteristically forming a powdery layer by using a powdery material of the wear-resistant copper-base alloy according to each claim and depositing the powdery material on a substrate, melting the powdery layer and then solidifying the molten layer, thereby forming a cladding layer with excellent wear resistance.

(Appendix 7) A method of producing a sliding member according to Appendix 6, characterized in that the cladding layer is formed by rapid heating and rapid cooling.

(Appendix 8) A method of producing a sliding member according to Appendix 6, characterized in that the powdery layer is melted by a high-density energy heat source selected from a laser beam, an electron beam and an arc.

(Appendix 9) A method of producing a sliding member according to Appendix 5 or Appendix 6, characterized in that the substrate is formed of aluminum or an aluminum alloy.

(Appendix 10) A method of producing a sliding member according to Appendix 5 or Appendix 6, characterized in that the substrate is a component or a portion (for example, a valve seat) of a valve train for an internal combustion engine.

(Appendix 11) A valve seat alloy formed of the wear-resistant copper-based alloy according to each claim.

(Appendix 12) A wear-resistant copper-based alloy according to each claim, characterized in that hard particles are dispersed in a matrix, the hard particles mainly comprise silicide and a Ni—Fe—Cr based solid solution, and the matrix mainly comprises a Cu—Ni based solid solution and silicide which includes nickel as a main component.

(Appendix 13) A powdery material formed of the wear-resistant copper-based alloy according to each claim.

(Appendix 14) A powdery material for cladding, formed of the wear-resistant copper-based alloy according to each claim.

(Appendix 15) A sliding member, characterized in that a cladding layer formed of the wear-resistant copper-based alloy recited in each claim is overlaid on a substrate.

(Appendix 16) A sliding member, characterized in that a cladding layer formed of the wear-resistant copper-based alloy recited in each claim is overlaid on a substrate formed of aluminum or an aluminum alloy as a base material.

INDUSTRIAL APPLICABILITY

As mentioned above, the wear-resistant copper-based alloy according to the present invention can be applied, for instance, to a copper-based alloy constituting sliding portions of sliding members typically exemplified by valve train components such as valve seats and valves for an internal combustion engine.

The invention claimed is:

1. A wear-resistant copper-based alloy, comprising, by weight, 4.7 to 22.0% nickel, 0.5 to 5.0% silicon, 2.7 to 22.0% iron, 1.0 to 15.0% chromium, 0.01 to 1.97% cobalt, 2.7 to 22.0% tantalum and/or hafnium, and the balance of copper with inevitable impurities.

2. A wear-resistant copper-based alloy according to claim 1, wherein silicide is dispersed therein.

3. A wear-resistant copper-based alloy according to claim 1, further comprising a matrix and hard particles dispersed in said matrix, said matrix having an average hardness of Hv 130 to 250 and said hard particles having a higher average hardness than that of said matrix.

4. A wear-resistant copper-based alloy according to claim 3, wherein said hard particles have an average particle diameter of 5 to 3000 μm.

5. A wear-resistant copper-based alloy according to claim 1, which is used for cladding.

6. A wear-resistant copper-based alloy according to claim 1, which is used for cladding by being melted by a high-density energy beam and then solidified.

7. A wear-resistant copper-based alloy according to claim 1, which constitutes a cladding layer to be clad on a substrate.

8. A wear-resistant copper-based alloy according to claim 1, which is used for a sliding member.

9. A wear-resistant copper-based alloy according to claim 1, which is used for valve train components for an internal combustion engine.

10. A wear-resistant copper-based alloy according to claim 1, wherein cobalt is set in a range of 0.2 to 1.9% by weight.

11. A wear-resistant copper-based alloy according to claim 1, wherein cobalt is set in a range of 0.4 to 1.85% by weight.

* * * * *